US005957058A

United States Patent [19]

Dampmann et al.

[11] Patent Number: 5,957,058

[45] Date of Patent: Sep. 28, 1999

[54] DRIVE UNIT FOR ELECTRIC RAIL VEHICLES

[75] Inventors: Ralf Dampmann; Erwin Skumawitz, both of Berlin, Germany

[73] Assignee: Abb Daimler-Benz Transportation GmbH, Henningsdorf, Germany

[21] Appl. No.: 08/894,407

[22] PCT Filed: Feb. 14, 1996

[86] PCT No.: PCT/EP96/00626

§ 371 Date: Aug. 18, 1997

§ 102(e) Date: Aug. 18, 1997

[87] PCT Pub. No.: WO96/25314

PCT Pub. Date: Aug. 22, 1996

[30] Foreign Application Priority Data

Feb. 17, 1995 [DE] Germany ..... 195 16 888

[51] Int. Cl.[6] ..... B61C 9/00

[52] U.S. Cl. ..... 105/96.1; 105/55; 105/99; 105/136

[58] Field of Search ..... 105/49, 54, 55, 105/96, 96.1, 99, 117, 118, 131, 132, 133, 136, 137, 138, 140; 310/255

[56] References Cited

U.S. PATENT DOCUMENTS

| | | | |
|---|---|---|---|
| 1,326,568 | 12/1919 | Buchli | 105/132 |
| 1,934,113 | 11/1933 | Buchli | 105/132 |
| 4,228,739 | 10/1980 | Fitzgibbon | 105/136 |

FOREIGN PATENT DOCUMENTS

| | | | |
|---|---|---|---|
| 5777 | 5/1979 | European Pat. Off. | 105/136 |
| 542171 | 5/1993 | European Pat. Off. | 105/133 |
| 928592 | 6/1955 | Germany . | |
| 2106662 | 8/1972 | Germany . | |
| 2438088 | 2/1976 | Germany . | |
| 2644414 | 3/1978 | Germany . | |
| 2805186 | 8/1979 | Germany . | |
| 2910392 | 8/1980 | Germany | 105/133 |
| 4137264 | 5/1993 | Germany . | |
| 575307 | 5/1976 | Switzerland . | |
| 380985 | 4/1932 | United Kingdom | 105/132 |

*Primary Examiner*—Mark T. Le
*Attorney, Agent, or Firm*—Venable; George H. Spencer; Ashley J. Wells

[57] ABSTRACT

The invention relates to a drive unit for electric rail vehicles, wherein the hub (7) of a greater wheel (6) driven by an electric traction motor (1) via a pinion shaft (4) forms a hollow shaft stub which surrounds the shaft (9) of a wheel set with a defined play. By inserting a coupling (11) which is radially rigid but allows transverse and angular movements, the motor torque is transmitted to one of the wheels (10) of the wheel set. The axial mobility of the coupling (11) should not have any disturbing restoring forces or resilient forces. Therefore, the hub-side coupling half **(11*b*) having a curved-teeth-shaped external toothing engages the wheel-side coupling half (11*a*) which is provided with a straight internal toothing. The wheel-side coupling half (11*a*) is detachably connected via coupling supports to the inside flank of a disk wheel (10) and the hub-side coupling half (11*b*)** to the hub.

1 Claim, 2 Drawing Sheets

DRIVE UNIT FOR ELECTRIC RAIL VEHICLES

BACKGROUND OF THE INVENTION

The invention relates to a drive unit for electric rail vehicles according to the preamble of the patent claim. A drive unit of this type is disclosed in DE-OS 21 06 662.

Particularly for fast-moving vehicles, the masses of non-spring-suspended components are intended to be kept as small as possible, to greatly contribute to preserving the guideway and to influence the riding performance. Therefore, for high-speed vehicles, fully spring-suspended drives have been generally accepted. For this purpose, the traction motors together with the geared transmissions are usually mounted in bogie frames and the torque transmission between transmission and the non-spring-suspended wheel sets (shaft with wheels) is designed such that relative movements can be absorbed within the framework of the spring deflections.

In contrast, there is the simply designed, classic nose-suspended drive whose most pronounced drawback, however, is that there are considerable reactions of the high portion of non-spring-suspended mass forces because of the direct, rigid support on the wheel set shaft. These reactions impair the vehicle dynamics in such a way that nose-suspended drives are ill-suited for higher running speeds. In these drives, there is no mobility transversely to the direction of travel (y-mobility) of the wheel set shaft.

By means of the drive unit known from the DE-OS 21 06 662 mentioned at the outset, the fully spring-suspended drives are simplified along the lines of non-spring-suspended drives and the advantages of both types of drives are combined in an advantageous drive system which reduces the mass forces in drives similar to nose-suspended drives by means of transverse flexibility.

In this drive unit according to DE-OS 21 06 662, the hollow shaft, on which the greater wheel of the transmission is seated and which surrounds the shaft of the wheel set, is supported against the driving wheel via an articulated lever coupling. But such an articulated lever coupling requires a relatively large amount of space. While it allows an axial mobility via an excursion of the articulated levers, this mobility manifests itself in a disadvantageous manner in the form of resilient restoring forces. These restoring forces, in turn, lead to undesirable axial vibrations of the articulated levers and thus of the drive unit.

According to DE 34 38 088 C1, a rubber-elastic coupling is provided for the transmission of force between a hollow shaft surrounding the driving axle of an electric rail vehicle and a driving wheel, which coupling is arranged between two metal rings disposed between a disk which is seated on the hollow shaft and a coupling disk which is screwed to the driving wheel. Here, the driving wheel is recessed on both sides of the wheel disk in the manner of an annular disk.

SUMMARY OF THE INVENTION

It is the object of the invention to configure a drive unit of the type mentioned at the outset in such a manner that the coupling, which serves as base point and articulation point for the reduction of the effects of mass forces and which is arranged between the hub of the hollow shaft stub and the flank of one of the wheels of the wheel set, is provided with an axial (i.e., possible transversely to the direction of travel) mobility without any disturbing restoring or resilient forces but that it remains rigid in the radial direction. At the same time, the coupling should be easy to install and its realization should take as little space as possible.

This object is solved according to the invention by the features characterized in the patent claim.

Advantageously, the coupling, of which only half is configured as a curved teeth coupling, allows a greater axial play without harmful restoring forces while it is rigid in the radial direction. Here, the advantage of reducing the effect of the mass forces of the drive unit is fully maintained. Furthermore, the coupling is space-saving on the wheel side and can be mounted easily on the driving wheel which is close-by and configured as a disk wheel. As a whole, it is also easy to assemble and disassemble the drive unit since the preassembled wheel set can be slid easily into the hollow shaft.

BRIEF DESCRIPTION OF THE DRAWINGS

The invention is explained below in greater detail by way of a schematic exemplary embodiment, reference being had to the accompanying drawings in which.

DETAILED DESCRIPTION OF THE PREFERRED EMBODIMENTS

Figure 1:
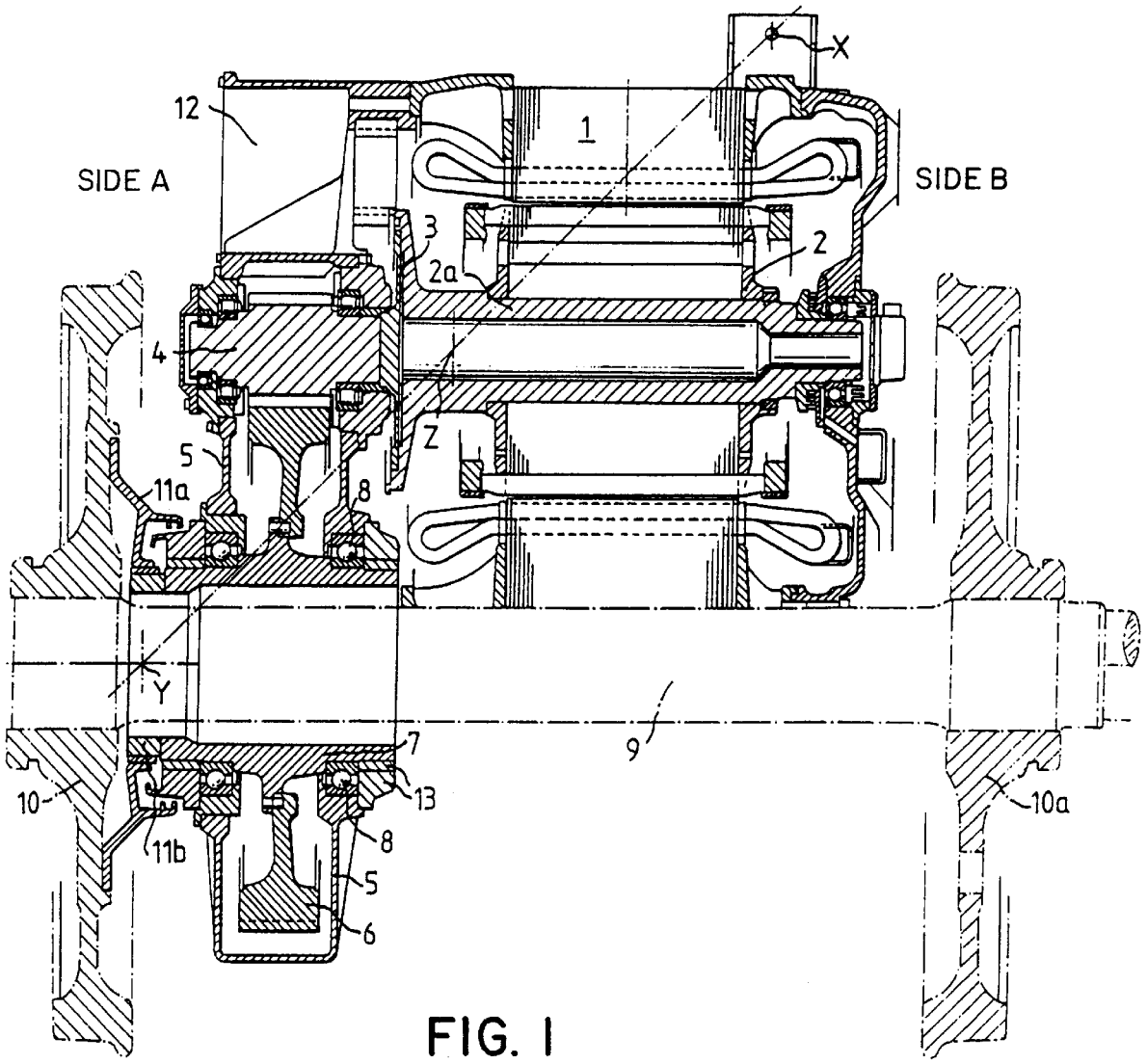
FIGS. 1 and 2 show a drive unit according to the present invention.

FIG. 1 illustrates a drive with an integrated traction motor 1 which has a complete bearing plate only on side B while it is integrated into the transmission on side A and is seated in combination with the transmission. For this purpose, the rotor 2 is coupled with its rotor shaft 2*a* to a pinion shaft 4 via a diaphragm coupling 3 which is axially and angularly soft but radially hard, with the pinion shaft being seated in a rigid transmission casing 5. A three-point bearing is provided for the rotor shaft 2*a* which is coupled to the pinion shaft 4. The transmission casing 5 is in direct frictional and positive lockup (screw connection) with the stator frame of the traction motor in the exact position and also includes a greater wheel 6 which is driven by the pinion shaft 4. The rotating greater wheel 6 is connected to a hub 7 which is supported in the surrounding rigid transmission casing 5 via roller bearings 8 engaging the hub circumference on the outside and which, as a hollow shaft stub, surrounds the shaft 9 of a wheel set comprising two wheels 10 and 10*a* with a defined radial play. The wheels 10, 10*a* are configured as disk wheels for purposes of mass reduction. The hub 7 seated in the transmission casing 5 is connected in a centered manner to the wheel 10 via a preferably grease-lubricated coupling 11 whose halves 11*a* and 11*b* are angularly movable with respect to one another and represent a joint which transmits a torque without radial displacement but with axial mobility.

Figure 2:
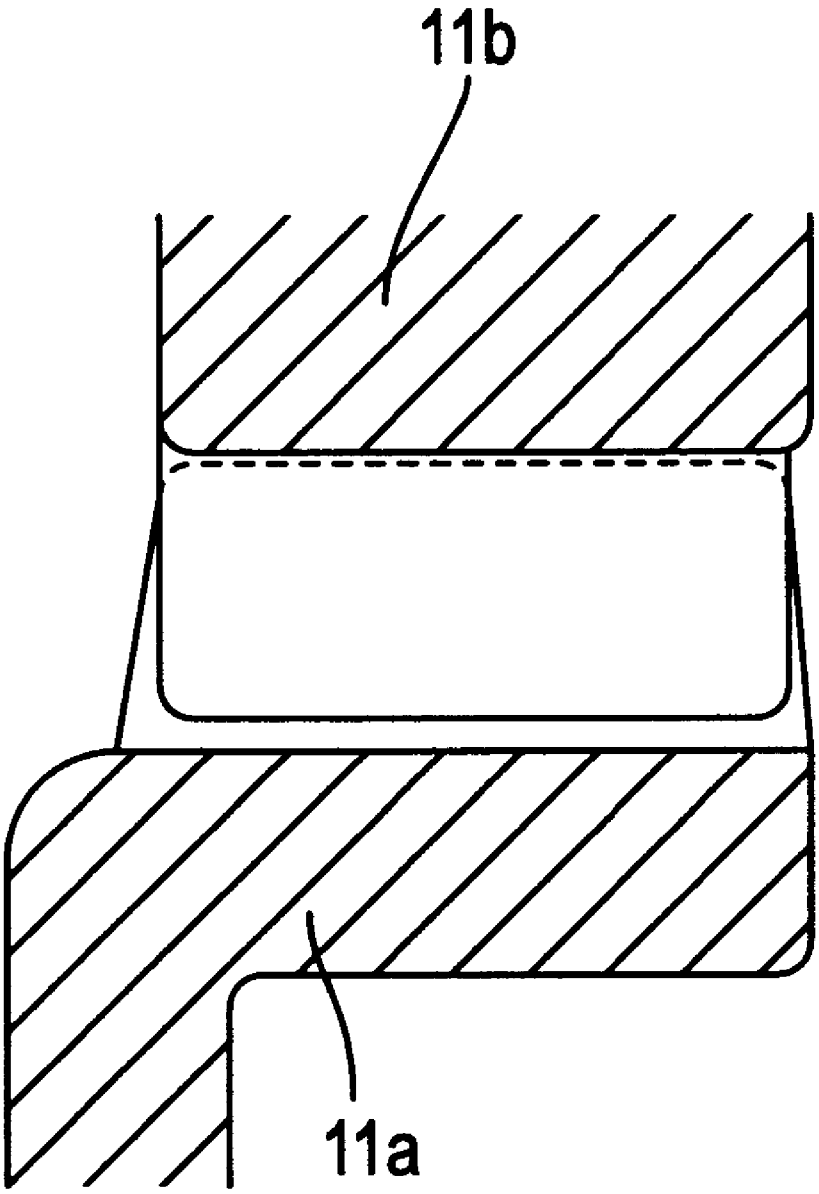

For this purpose, the wheel-side coupling half 11*a* is configured as a coupling sleeve with straight internal toothing and is connected with the inside flank of the disk wheel 10 via a coupling support. The hub-side coupling half 11*b* is provided with a curved-teeth-shaped external toothing and is connected to the hub 7, also via a coupling support as shown in FIG. 2. The coupling system serves as joint of the drive unit, with all of the movements of the wheel set taken on via its bending point Y. Of course, it is also possible to provide the coupling half 11*a* with an external toothing and the coupling half 11*b* with an internal toothing.

Additionally, 12 identifies an air intake nipple for a motor ventilation on side A. Furthermore, this drive also comprises proven constructional elements such as an oil lubrication system of the greater wheel seating (8) and contactless labyrinth seals (13) between hub 7 and transmission casing

5. The rigid undivided transmission casing 5 also has a lower flange-mounted oil pan, not shown here, which, after separation, opens a casing aperture serving for assembly work on the greater wheel 6 and/or of an intermediate wheel (e.g., for installing brake disks).

The suitable suspension point X for the traction motor 1 on the bogie frame is obtained from an extension of a straight connecting line between two fixed points of which the one is determined by the central bending point Y in the coupling 11 and the other fixed point is the overall center of gravity Z of the drive system including traction motor 1. Any mass forces that are still free can be absorbed via the rigidity of the bogie frame suspension and/or an additional rolling support.

Owing to the fact that the wheel set shaft 9 can be displaced by a specific amount (axial mobility of the coupling) in the y-direction (i.e., transversely to the direction of travel), reactions of the traction motor mass upon the guidance forces of the wheel are eliminated. Similarly, transverse accelerations of the wheel during the negotiation of curves or hunting movements in the track are now only transmitted up to coupling half 11*a*, thus reducing wheel flange wear and rail wear. In the case of transverse movements, there remains only the wheel set with the respective coupling half 11*a* as non-spring-suspended mass. In the case of vertical spring suspensions of the wheels, a reduced entrainment of the motor mass is a positive further feature. For the left wheel 10, this results in a defined pivot movement around the bending point Y without any load by the motor mass. For the right wheel 10*a*, the portion of the motor mass is reduced because of the long lever arm of the wheel set shaft 9.

Further advantages ensue during the installation of the wheel set 10/10*a*. On the one hand, the wheel set shaft 9 with the wheel 10 including the preassembled coupling sleeve (coupling half 11*a*) must be threaded through the hollow transmission shaft, i.e., the hub 7. On the other hand, only the disk wheel 10*a* must be mounted until the toothing of both coupling halves 11*a* and 11*b* are in engagement. Complex additional assembling steps are omitted, e.g., the pressing on of the greater wheel, bearings and other components.

The hub 7 as main transmission shaft can also be coupled easily with a brake disk support. In a configuration with brake disks, an intermediate wheel transmission is used. An important advantage in a configuration of the drive with brake disks is that it is not necessary to take out the transmission when worn brake disks are replaced but that it is only necessary to separate the wheel set and the brake disk from the brake disk support, which is not a very complex process.

We claim:

1. A drive unit for electric rail vehicles, comprising:

an electric motor;

a pinion shaft extending from the electric motor;

a greater wheel connected to the pinion shaft so as to be driven by the pinion shaft, said greater wheel having hub in the form of a hollow shaft stub which surrounds a shaft of a wheel set, said hollow shaft stub being spaced from said wheel set shaft by a distance to provide play;

a wheel of said wheel set being connected to said hollow shaft stub by a coupling which includes a hub-side coupling half having a curve-shape external toothing engaging a wheel-side coupling half having a straight-shape internal toothing on a sleeve, said sleeve being connected in a detachable manner to an inside flank of the wheel; and wherein, said coupling is rigid in the radial direction of the wheel, while said coupling allows relative transverse and angular movements between the wheel and the hollow shaft stub.

* * * * *